US007785131B2

(12) United States Patent
Ferderer et al.

(10) Patent No.: US 7,785,131 B2
(45) Date of Patent: Aug. 31, 2010

(54) INTERLOCKING DEVICE FOR PLUG CONNECTOR HOUSINGS

(75) Inventors: Albert Ferderer, Espelkamp (DE); Stefan Schnieder, Bohmte (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 12/481,471

(22) Filed: Jun. 9, 2009

(65) Prior Publication Data

US 2009/0311905 A1 Dec. 17, 2009

(30) Foreign Application Priority Data

Jun. 13, 2008 (DE) ..... 10 2008 028 367

(51) Int. Cl.
*H01R 13/62* (2006.01)

(52) U.S. Cl. ..... 439/372; 439/157

(58) Field of Classification Search ..... 439/153–160, 439/341–343, 372, 376
See application file for complete search history.

(56) References Cited

U.S. PATENT DOCUMENTS 5,395,258 A * 3/1995 Okumura et al. ..... 439/157
5,401,179 A * 3/1995 Shinchi et al. ..... 439/157
5,417,513 A * 5/1995 Hayashi ..... 403/321
5,658,162 A 8/1997 Harting et al. ..... 439/372
6,142,787 A * 11/2000 Ikesugi ..... 439/15
7,090,518 B1 * 8/2006 Osada et al. ..... 439/157
7,335,038 B2 * 2/2008 Duval ..... 439/157
7,462,060 B2 * 12/2008 Hamoignon ..... 439/409

FOREIGN PATENT DOCUMENTS

EP 0 731 534 9/1996

* cited by examiner

*Primary Examiner*—Thanh-Tam T Le
(74) *Attorney, Agent, or Firm*—Hayes Soloway P.C.

(57) ABSTRACT

The invention proposes an interlocking device for a two-part plug connector housing that is composed of two punched and bent one-piece interlocking elements in connection with an exchangeable actuating handle. In this case, the interlocking elements feature a clip-on side, by means of which they are engaged in the actuating handle, and an interlocking side that is realized in the form of a C-shaped spring element, rotably held on a pivot pin of the lower plug connector housing half and can be interlocked on a locking pin of the upper plug connector housing half.

5 Claims, 4 Drawing Sheets

INTERLOCKING DEVICE FOR PLUG CONNECTOR HOUSINGS

BACKGROUND OF THE INVENTION

1. Field of the Invention

The invention pertains to an interlocking device for plug connector housings comprising an actuating handle that approximately takes up the housing width of the plug connector housing and interlocking elements attached to both sides thereof, wherein said interlocking elements are rotatably arranged on pivot pins on a first plug connector housing half and can be interlocked on locking pins of a second plug connector housing half.

An interlocking device of this type is required for connecting two plug connector housing halves to one another in an environmentally safe fashion.

2. Description of the Related Art

EP 0 731 534 B1 discloses an electric plug connector, in which the side parts of a U-shaped interlocking shackle that can be pivoted about one connector half feature pockets, in which an interlocking device is arranged that consists of a specially shaped spring and a toggle lever-like interlocking element and makes it possible to interlock the plug connection—in cooperation with an interlocking pin on the second housing half.

This interlocking device requires several small components and a complicated manufacture of the interlocking shackle that can be replaced with a significantly simplified construction.

SUMMARY OF THE INVENTION

Consequently, the invention is based on the objective of developing a cost-effective interlocking device with the simplest mechanical design possible for two matable plug connector housings.

This objective is attained in that the interlocking element for interlocking the two plug connector housing halves features an interlocking side, as well as a clip-on side for producing the connection with the actuating handle, in that the interlocking side features a C-shaped spring element that is composed of a first limb and a second limb and integrally moulded onto the clip-on side of the interlocking element by means of a second web, in that a crescent-shaped lug is arranged on the interlocking element in the interior of the C-shaped spring element by means of a first web, in that a semicircular opening is provided on the end of the first limb of the C-shaped spring element and forms a pivot point about the pivot pin on the first plug connector housing half together with a rounding on the end of the crescent-shaped lug, and in that a depression is provided on the second limb of the spring element in order to lock the interlocking element by means of a locking pin that is arranged on the second plug connector housing half.

The invention describes an interlocking device for plug connector housings, particularly so-called heavy-duty plug connectors, in which the two connector halves need to be interlocked in such a way that an environmentally safe protection of the internal plug assemblies is ensured.

The advantages attained with the invention can be seen, in particular, in that the interlocking device is formed by an exchangeable actuating handle, to which interlocking elements that are bent by 90° can be respectively attached on the right and the left side in a clip-on fashion.

This provides the additional advantage that the actuating handle can be manufactured of different materials and exchanged by the user himself in dependence on the respective application.

In this case, a plastic part can, for example, be exchanged for a handle of special steel as it is required, in particular, under difficult environmental conditions.

The interlocking elements preferably are also manufactured of special steel sheets in this case.

According to the invention, the advantages of a toggle lever construction are achieved with a correspondingly shaped one-piece construction of an interlocking device with an integrated C-shaped spring element because this interlocking device can be easily manufactured in the form of a prefabricated punched part.

The spring element is arranged on a web on the interlocking device at a point that approximately lies in the center of its two limbs. A crescent-shaped lug arranged in the interior of the spring element is provided on a continuing web.

A rounded end of the lug features a semicircular recess in one of the limbs such that a pivot point in the form of an opening is formed between the recess and the end of the lug.

This opening features a passage that is slightly smaller than the opening such that the interlocking device can be clipped—and is held—on pivot pins laterally arranged on the lower housing half and pivoted by a certain amount in order to respectively interlock and unlock the two housing halves.

This pivoting movement specifically takes place until the locking pin of the upper plug connector housing half snaps into a depression provided on the second limb and is ultimately blocked by the second half of the crescent-shaped lug extending up to this upper limb.

This is also the point, at which the locking effect between the upper and the lower housing half, as well as its tightness achieved with the aid of a rubber seal arranged in between, has reached its optimum.

The spring element with a web connected thereto approximately in the center of the two limbs provides the advantage that the limbs can act relatively independent of one another, namely during the clipping on the pivot pins, as well as during the interlocking of the two housing halves by engaging the locking pin in the depression on the second limb.

Another advantage is that the spring element only requires one punched part that is respectively bent to the right or the left by 90° in the plane of the sheet in order to be mounted on the actuating handle.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1:
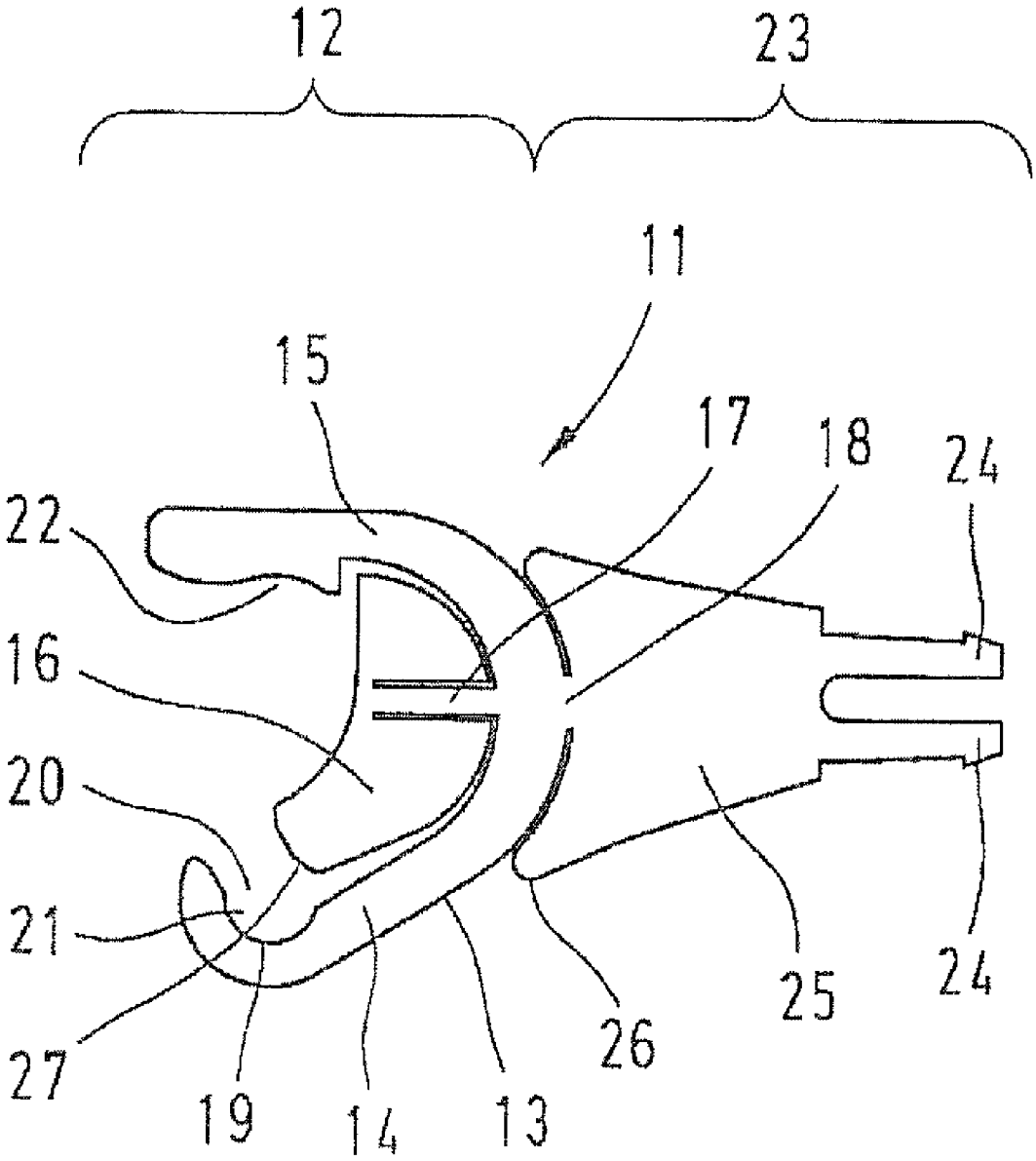
FIG. 1 a top view of a non-angled interlocking element.

FIG. 1 shows an interlocking element 11 of an interlocking device 10 before it is angularly bent for use in an actuating handle 30 that is attached to both sides of a connector housing half 3.

The interlocking element 11 is punched out of a springable material in the form of a one-piece element and features an interlocking side 12 and a clip-on side 23 with an angled section 25.

The clip-on side 23 features two catch hooks 24 that are spaced apart from one another and provided for engaging with the actuating handle 30, wherein said catch hooks are integrally moulded onto the wing-like angled section 25.

The interlocking side 12 is realized in the form of a C-shaped spring element 13, in the interior of which a crescent-shaped lug 16 is arranged and connected by means of a first web 17. In this case, the first web 17 is moulded into the crescent-shaped lug 16.

The spring element 13 is connected to the clip-on side 23 by means of a second web 18.

Consequently, the two limbs 14, 15 of the spring element 13 are able to move relatively independent of one another.

A pivot point 21 is formed together with a rounding 27 on the end of the crescent-shaped lug 16 and, in this case, the lower second limb 14 and a semicircular recess 19, wherein the spring element 13 is held on a pivot pin 4 of the first—in this case lower—plug connector housing half 3 such that it can be pivoted about said pivot point within a certain range. The second limb 15 features a slight depression 22 provided for engaging with a locking pin 7 on the second plug connector housing half 6.

In this case, the upper part of the crescent-shaped lug 16 ultimately represents a limit stop for the locking pin 7 during the pivoting of the interlocking device 10.

In addition, the wing-like angled section 25 features exposed corner sections 26 to both sides of the web 18, wherein said corner sections form an overload protection in order to protect the second web 18 from fracturing depending on the deflection of the spring element during the interlocking of the second plug connector housing half.

Figure 2:
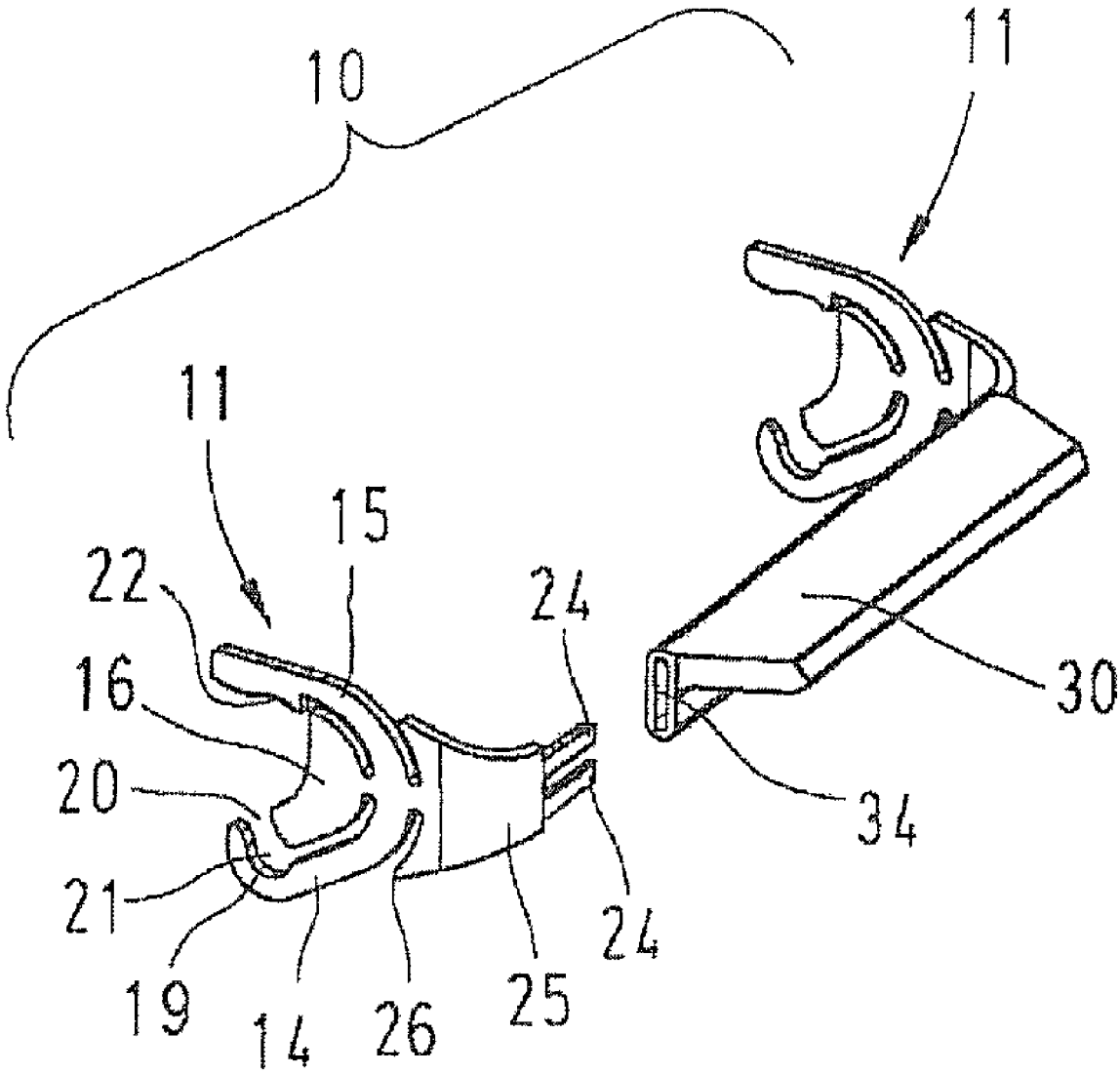
FIG. 2 a perspective representation of an actuating handle with one interlocked and one non-interlocked interlocking element.

FIG. 2 shows a perspective representation of the interlocking element 11, wherein the interlocking side 12 and the clip-on side 23 are bent in the plane of the sheet by approximately 90° within the angled section 25.

Figure 3A:
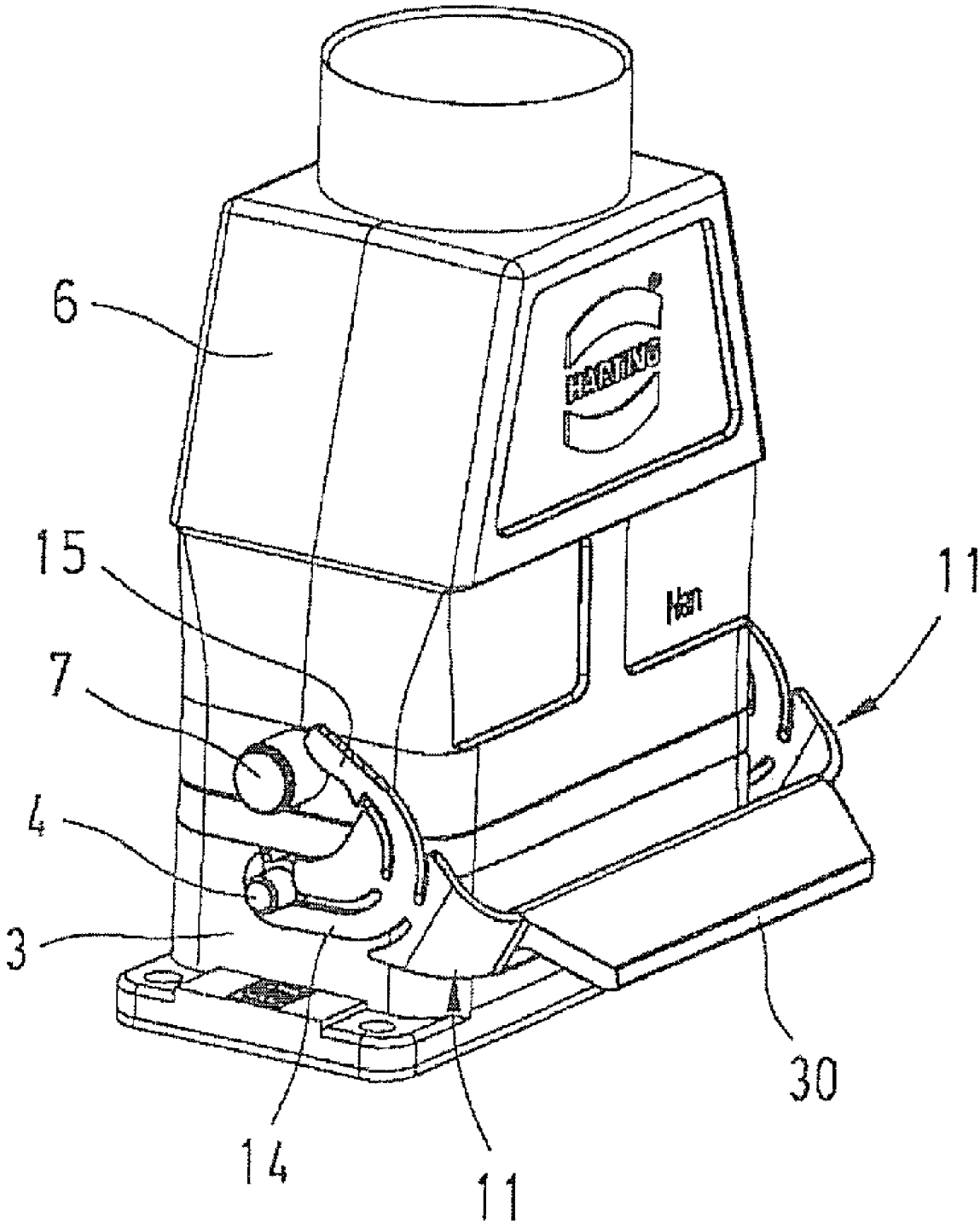
FIG. 3*a* a side view of a non-interlocked plug connector housing.
Figure 3B:
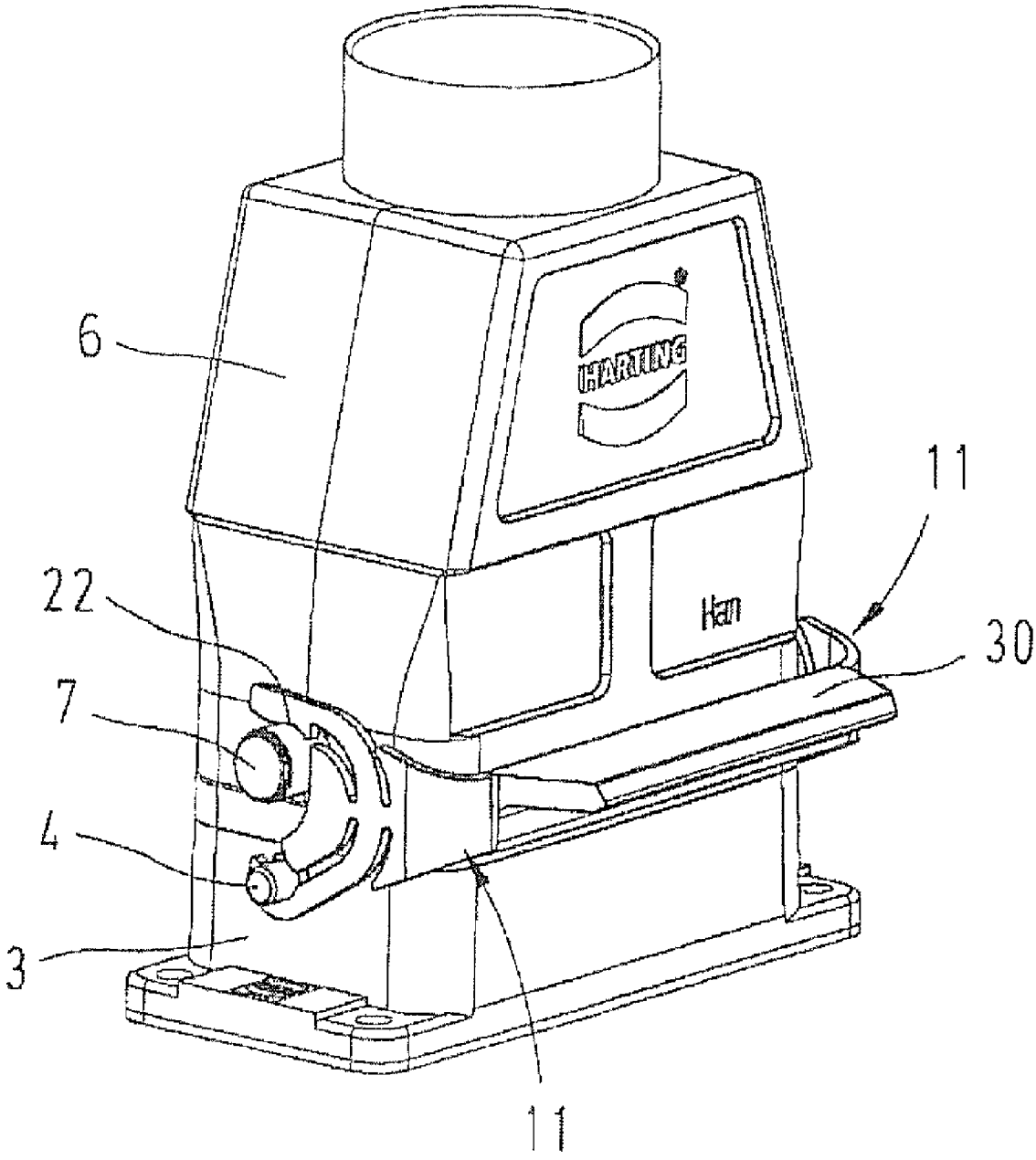
FIG. 3*b* a side view of interlocked plug connector housings.

FIGS. 3*a* and 3*b* respectively show the two interconnected plug connector housing halves 3, 6 with the interlocking device 10.

In this case, FIG. 3*a* shows a non-interlocked representation of the interlocking device and FIG. 3*b* shows and interlocked representation of the interlocking device.

In this context, it should be noted that the interlocking element 11 is merely attached to the pivot pin 4 in a clip-on fashion such that the pivot point 21 is formed by means of the passage 20 and the semicircular opening 19.

When the interlocking device 10 is pivoted in the direction of the housing half 6, the second limb 15 engages with the depression 22 on the locking pin 7 and the two plug connector housing halves 3, 6 are reliably interlocked.

What is claimed is:

1. An interlocking device for plug connector housings comprising a first plug connector housing and a second plug connector housing and an actuating handle having an approximate width of the plug connector housings and with interlocking elements attached to both sides thereof, wherein said interlocking elements are rotatably arranged on pivot pins on a first plug connector housing half and can be interlocked on locking pins of a second plug connector housing half, wherein the interlocking elements for interlocking the two plug connector housing halves features an interlocking side, as well as a clip-on side for producing the connection with the actuating handle, wherein the interlocking side features a C-shaped spring element that is composed of a first limb and a second limb and integrally moulded onto the clip-on side of the interlocking element by means of a second web, wherein a crescent-shaped lug is arranged on the interlocking element in an interior of the C-shaped spring element by means of a first web, wherein a semicircular opening is provided on one end of the first limb of the C-shaped spring element and forms a pivot point about a pivot pin on the first plug connector housing half together with a rounding on the end of the crescent-shaped lug, and wherein a depression is provided on the second limb of the C-shaped spring element in order to lock the interlocking element by means of a locking pin that is arranged on the second plug connector housing half.

2. The interlocking device according to claim 1, wherein the interlocking element can be connected to the actuating handle by means of catch hooks on the clip-on side.

3. The interlocking device according to claim 1, wherein the interlocking element features the interlocking side for interlocking the first and the second plug connector housing halves, as well as the clip-on side for producing the connection with the actuating handle, connected together by means of an angled section that is bent by 90° in the plane of the sheet.

4. The interlocking device according to claim 1, wherein that the interlocking element can be clipped on the pivot point on the pivot pin of the first plug connector housing half that is realized in the form of a passage formed by the semicircular opening on the first limb and the rounding on the end of the crescent-shaped lug.

5. The interlocking device according to claim 3, wherein the angled section features exposed corner sections to both sides of the second web.

* * * * *